US009728296B2

(12) United States Patent
Oya et al.

(10) Patent No.: US 9,728,296 B2
(45) Date of Patent: Aug. 8, 2017

(54) INSULATED WIRE, ELECTRICAL EQUIPMENT, AND METHOD OF PRODUCING INSULATED WIRE

(71) Applicants: FURUKAWA ELECTRIC CO., LTD., Tokyo (JP); FURUKAWA MAGNET WIRE CO., LTD., Tokyo (JP)

(72) Inventors: Makoto Oya, Tokyo (JP); Makoto Onodera, Tokyo (JP); Keiichi Tomizawa, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 154 days.

(21) Appl. No.: 14/700,596

(22) Filed: Apr. 30, 2015

(65) Prior Publication Data

US 2015/0310959 A1 Oct. 29, 2015

Related U.S. Application Data

(63) Continuation of application No. PCT/JP2013/082818, filed on Dec. 6, 2013.

(30) Foreign Application Priority Data

Dec. 28, 2012 (JP) ..... 2012-287114

(51) Int. Cl.
*H01B 3/30* (2006.01)
*H01B 13/14* (2006.01)
(Continued)

(52) U.S. Cl.
CPC ..... *H01B 3/30* (2013.01); *H01B 7/0283* (2013.01); *H01B 13/065* (2013.01); *H01B 13/14* (2013.01); *H01B 13/142* (2013.01); *H01F 5/06* (2013.01)

(58) Field of Classification Search
USPC ..... 174/36, 110 R–110 PM
See application file for complete search history.

(56) References Cited

U.S. PATENT DOCUMENTS 4,473,665 A * 9/1984 Martini-Vvedensky B29C 44/34 264/237
5,358,786 A * 10/1994 Ishikawa ..... H01B 3/30 174/110 AR (Continued)

FOREIGN PATENT DOCUMENTS

CN 102138186 A 7/2011
CN 102782773 A 11/2012

(Continued)

OTHER PUBLICATIONS

Japanese Office Action dated Aug. 16, 2016, for Japanese Application No. 2014-521870 including an English translation.

(Continued)

*Primary Examiner* — William H Mayo, III
(74) *Attorney, Agent, or Firm* — Birch, Stewart, Kolasch & Birch, LLP

(57) ABSTRACT

An insulated wire having a conductor, a foamed insulating layer containing a thermosetting resin having cells, coated directly or indirectly onto the outer periphery of the conductor and an outer insulating layer containing a thermoplastic resin having a melting point of 240° C. or higher when the thermoplastic resin is a crystalline resin or a thermoplastic resin having a glass transition temperature of 240° C. or higher when the thermoplastic resin is a non-crystalline resin; electrical equipment using the insulated wire; and a method of producing the insulated wire, containing a step of forming a foamed insulating layer by applying a varnish for forming the foamed insulating layer on the outer periphery of a conductor, by generating foams during baking and a step of forming an outer insulating layer (Continued)

by extrusion-molding a thermoplastic resin composition for forming the outer insulating layer on the outer periphery of the foamed insulating layer.

7 Claims, 2 Drawing Sheets

(51) Int. Cl.

| | |
|---|---|
| ***H01F 5/06*** | (2006.01) |
| ***H01B 7/02*** | (2006.01) |
| ***H01B 13/06*** | (2006.01) |

(56) References Cited

U.S. PATENT DOCUMENTS

| | | | | |
|---|---|---|---|---|
| 5,426,264 | A * | 6/1995 | Livingston | H01B 7/046 174/102 R |
| 5,492,761 | A * | 2/1996 | Shukushima | H01B 3/301 174/110 A |
| 5,606,152 | A * | 2/1997 | Higashiura | H01B 3/421 174/120 R |
| 5,965,263 | A * | 10/1999 | Tatematsu | C09D 179/08 174/110 PM |
| 6,359,230 | B1 * | 3/2002 | Hildreth | H01B 7/292 174/110 R |
| 7,087,843 | B2 * | 8/2006 | Ishii | H01B 3/301 174/110 R |
| 8,946,557 | B2 * | 2/2015 | Fukuda | H01B 3/301 174/110 AR |
| 9,111,666 | B2 * | 8/2015 | Furukawa | H01B 3/301 |
| 9,142,334 | B2 * | 9/2015 | Muto | H01B 3/301 |
| 2008/0187759 | A1 * | 8/2008 | Fukuda | H01B 3/301 428/411.1 |
| 2011/0226508 | A1 | 9/2011 | Aoi et al. | |
| 2012/0279752 | A1 | 11/2012 | Oya et al. | |
| 2012/0285724 | A1 | 11/2012 | Oya et al. | |

FOREIGN PATENT DOCUMENTS

| | | | | |
|---|---|---|---|---|
| JP | 59-40409 | A | 3/1984 | |
| JP | 6-290644 | A | 10/1994 | |
| JP | 3040034 | U | 8/1997 | |
| JP | 3276665 | B2 | 4/2002 | |
| JP | 3299552 | B2 | 7/2002 | |
| JP | 3496636 | B2 | 2/2004 | |
| JP | 2005-203334 | A | 7/2005 | |
| JP | 2006-31980 | A | 2/2006 | |
| JP | 4584014 | B2 | 11/2010 | |
| JP | 2011-238384 | A | 11/2011 | |
| JP | 2012-113836 | A | 6/2012 | |
| JP | 2013-187029 | A | 9/2013 | |
| TW | 201140620 | A * | 11/2011 | H01B 3/30 |

OTHER PUBLICATIONS

Chinese Office Action and Search Report, issued Feb. 2, 2016, for Chinese Application No. 201380015179.1, along with English translations.

International Search Report, issued in PCT/JP2013/082818, dated Feb. 18, 2014.

* cited by examiner

INSULATED WIRE, ELECTRICAL EQUIPMENT, AND METHOD OF PRODUCING INSULATED WIRE

CROSS-REFERENCE TO RELATED APPLICATIONS

This application is a continuation of PCT/JP2013/082818 filed on Dec. 6, 2013 which claims benefit of Japanese Patent Application No. 2012-287114 filed on Dec. 28, 2012, the subject matters of which are incorporated herein by reference in their entirety.

TECHNICAL FIELD

The present invention relates to an insulated wire, electrical equipment, and a method of producing the insulated wire.

BACKGROUND ART

Inverters have been installed in many types of electrical equipment, as an efficient variable-speed control unit. Inverters are switched at a frequency of several kHz to tens of kHz, to cause a surge voltage at every pulse thereof. Inverter surge is a phenomenon in which reflection occurs at a breakpoint of impedance, for example, at a starting end, a termination end, or the like of a connected wire in the propagation system, and as a result, a voltage up to twice as high as the inverter output voltage is applied. In particular, an output pulse occurred due to a high-speed switching device, such as an IGBT, is high in steep voltage rise. Accordingly, even if a connection cable is short, the surge voltage is high, and further voltage decay due to the connection cable is low. As a result, a voltage almost twice as high as the inverter output voltage occurs.

As coils for electrical equipment such as inverter-related equipment, for example, high-speed switching devices, inverter motors and transformers, insulated wires, which are enameled wires, are mainly used as magnet wires in the coils. Accordingly, as described above, since a voltage nearly twice as high as the inverter output voltage is applied in inverter-related equipment, it has been required in insulated wires to minimize partial discharge deterioration, which is attributable to inverter surge.

In general, partial discharge deterioration means a phenomenon in which the following deteriorations of the electrical insulating material occur in a complicated manner: molecular chain breakage deterioration caused by collision with charged particles that have been generated by partial discharge (discharge at a portion in which fine void defect exists); sputtering deterioration; thermal fusion or thermal decomposition deterioration caused by local temperature rise; and chemical deterioration caused by ozone generated due to discharge, and the like. The electrical insulating materials which actually have been deteriorated by partial discharge show reduction in the thickness.

In order to prevent deterioration of an insulated wire caused by such partial discharge, insulated wires having improved resistance to corona discharge by incorporating particles into an insulating film have been proposed. For example, an insulated wire incorporating metal oxide fine particles or silicon oxide fine particles into an insulating film (see Patent Literature 1), and an insulated wire incorporating silica into an insulating film (see Patent Literature 2) have been proposed. These insulated wires reduce erosive deterioration caused by corona discharge, by the insulating films containing particles. However, the insulated wires having insulating films containing these particles have problems that the effect is insufficient so that a partial discharge inception voltage is decreased and flexibility of the coated film is decreased.

There is also available a method of obtaining an insulated wire which does not cause partial discharge, that is, an insulated wire having a high partial voltage at which partial discharge occurs. In this regard, a method of making the thickness of the insulating layer of an insulated wire thicker, or using a resin having a low relative dielectric constant in the insulating layer can be considered.

However, when the thickness of the insulating layer is increased, the resultant insulated wire becomes thicker, and as a result, size enlargement of electrical equipment is brought about. This goes against the demand in recent miniaturization of electrical equipment represented by motors and transformers. For example, specifically, it is no exaggeration to say that the performance of a rotator, such as a motor, is determined by how many wires are held in a stator slot. As a result, it has been required in recent years to particularly increase the ratio (space factor) of the sectional area of conductors to the sectional area of the stator slot. Therefore, increasing the thickness of the insulating layer leads to a decrease in the space factor, and this is not desirable when the required performance is taken into consideration.

On the other hand, with respect to the relative dielectric constant of an insulating layer, most of the resins that are generally used as a material for the insulating layer have a relative dielectric constant from 3 to 4, and thus there is no resin having a specifically low relative dielectric constant. Furthermore, in practice, a resin having a low relative dielectric constant cannot always be selected necessarily when other properties that are required for the insulating layer (heat resistance, solvent resistance, flexibility and the like) are taken into consideration.

As a means for decreasing a substantial relative dielectric constant of the insulating layer, such a measure has been studied as forming the insulating layer from foam, and foamed wires containing a conductor and a foamed insulating layer have been widely used as communication wires. Conventionally, foamed wires obtained by, for example, foaming an olefin-based resin such as polyethylene or a fluorine resin have been well-known. Specific examples include foamed polyethylene insulated wires (see Patent Literature 3), foamed fluorine resin insulated wires (see Patent Literature 4), and the like.

However, these conventional foamed wires have a poor scratch resistance and therefore cannot satisfy properties required for the insulated wire.

CITATION LIST

Patent Literatures

Patent Literature 1: Japanese Patent No. 3496636
Patent Literature 2: Japanese Patent No. 4584014
Patent Literature 3: Japanese Patent No. 3299552
Patent Literature 4: Japanese Patent No. 3276665

SUMMARY OF INVENTION

Technical Problem

The present invention was achieved in order to solve the problems described above, and the present invention is contemplated for providing an excellent insulated wire having a high partial discharge inception voltage and abrasion resistance (scratch resistance), and a method for producing the insulated wire.

Further, the present invention is contemplated for providing electrical equipment using the insulated wire having excellent performance.

Solution to Problem

The above-described problems can be solved by the following means.

(1) An insulated wire comprising:

a conductor;

a foamed insulating layer containing a thermosetting resin having cells (air bubbles), coated directly or indirectly onto the outer periphery of the conductor; and an outer insulating layer containing a thermoplastic resin having a melting point of 240° C. or higher in the case where the thermoplastic resin is a crystalline resin or a thermoplastic resin having a glass transition temperature of 240° C. or higher in the case where the thermoplastic resin is a non-crystalline resin, on the outer side of the foamed insulating layer.

(2) The insulated wire as described in the above item (1), wherein the thermoplastic resin has a storage elastic modulus of 1 GPa or more at 25° C.

(3) The insulated wire as described in the above item (1) or (2), wherein a thickness ratio of the foamed insulating layer to the outer insulating layer (foamed insulating layer/outer insulating layer) is from 5/95 to 95/5.

(4) The insulated wire as described in any one of items (1) to (3), wherein the thermoplastic resin comprises a crystalline thermoplastic resin having a melting point of 270° C. or higher.

(5) The insulated wire as described in any one of items (1) to (4), used for a motor coil.

(6) A method of producing the insulated wire as described in any one of items (1) to (5), comprising the steps of:

forming a foamed insulating layer by applying directly or indirectly a varnish for forming the foamed insulating layer on the outer periphery of a conductor, and by generating foams in the process of baking; and forming an outer insulating layer by extrusion-molding a thermoplastic resin composition for forming the outer insulating layer on the outer periphery of the foamed insulating layer.

(7) Electrical equipment, using the insulated wire as described in any one of items (1) to (5).

In the present invention, the term "crystalline" means a characteristic that a regularly-arranged crystalline organization can be held in at least a part of the polymer chain under favorable environments for crystallization. The term "non-crystalline" means retaining an amorphous state which holds almost no crystalline structure and a characteristic that the polymer chain becomes a random state at the time of curing.

Further, in the present invention, the terms "glass transition temperature" and "melting point" mean the lowest glass transition temperature or melting point when the thermoplastic resin has a plurality of glass transition temperatures or melting points.

Further, in the present invention, the expression "indirectly coat" means that a foamed insulating layer coats a conductor via another layer, and the expression "indirectly applied" means that a varnish is applied onto a conductor via another layer. Here, examples of the other layer include an inner insulating layer having no cells, an adhesion layer (adhesive layer) and the like each of which is other than the foamed insulating layer.

Other and further features and advantages of the invention will appear more fully from the following description, appropriately referring to the accompanying drawings.

Advantageous Effects of Invention

According to the present invention, an insulated wire which is excellent in both a partial discharge inception voltage and abrasion resistance and its production method can be provided. In addition, according to the present invention, electrical equipment using the insulated wire having excellent performances can be provided.

DETAILED DESCRIPTION OF THE INVENTION

An embodiment of the foamed wire of the present invention will be explained, with reference to the drawings.

Figure 1A:
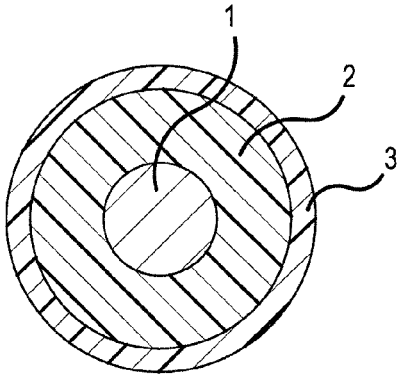
FIG. 1(*a*) is a cross-sectional view showing an embodiment of the insulated wire of the present invention, and FIG. 1(*b*) is a cross-sectional view showing another embodiment of the insulated wire of the present invention.
Figure 1B:
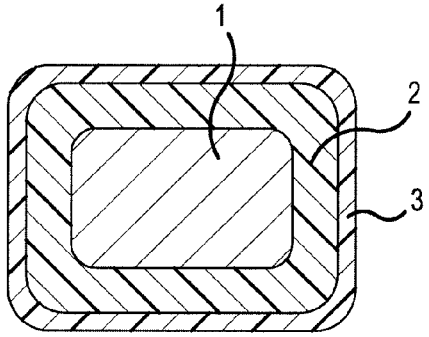

In one embodiment of the insulated wire of the present invention, whose cross-sectional view is shown in FIG. 1(*a*), the insulated wire has, as components thereof, conductor 1 with a circular cross-section; foamed insulating layer 2 composed of a thermosetting resin, the resin coating the outer periphery of conductor 1; and outer insulating layer 3 composed of a thermoplastic resin, the resin coating the outer periphery of foamed insulating layer 2. In this embodiment, the cross-section of each of foamed insulating layer 2 and outer insulating layer 3 is also circular.

In another embodiment of the insulated wire of the present invention, whose cross-sectional view is shown in FIG. 1(*b*), the conductor having a rectangular cross-section is used as conductor 1, and other parts of the configuration are basically the same as the configuration of the insulated wire shown in FIG. 1(*a*). In this embodiment, since the cross-section of conductor 1 is rectangular, foamed insulating layer 2 composed of a thermosetting resin and outer insulating layer 3 composed of a thermoplastic resin also have rectangular cross-sections.

Figure 2A:
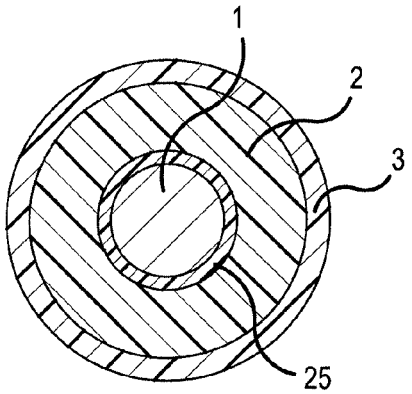
FIG. 2(*a*) is a cross-sectional view showing still another embodiment of the insulated wire of the present invention, and FIG. 2(*b*) is a cross-sectional view showing yet another embodiment of the insulated wire of the present invention.
Figure 2B:
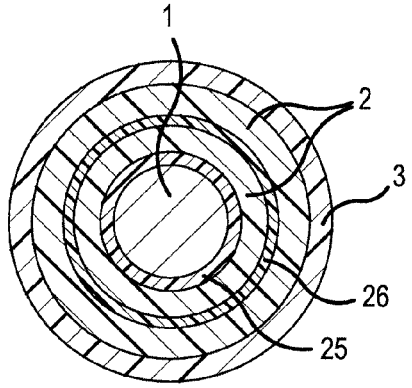

In still another embodiment of the insulated wire of the present invention, whose cross-sectional view is shown in FIG. 2(*a*), the insulated wire is the same as the insulated wire shown in FIG. 1(*a*), except that inner insulating layer 25 composed of a thermosetting resin is provided on the inside of foamed insulating layer 2 composed of a thermosetting resin having cells and at the same time on the outer periphery of conductor 1.

In still another embodiment of the insulated wire of the present invention, which is shown in FIG. 2(*b*), the insulated wire is the same as the insulated wire shown in FIG. 2(*a*), except that the insulated wire has internal insulating layer 26 which divides foamed insulating layer 2 into two layers in the thickness direction thereof. Specifically, in this embodiment, inner insulating layer 25, foamed insulating layer 2, internal insulating layer 26, and foamed insulating layer 2, and outer insulating layer 3 are laminatedly formed in this order on conductor 1.

In the present invention, the inner insulating layer is basically the same as the foamed insulating layer, except that the inner insulating layer has no cells. The internal insulating layer is basically the same as the inner insulating layer, except that the position at which the layer is formed is different from one another.

Figure 3A:
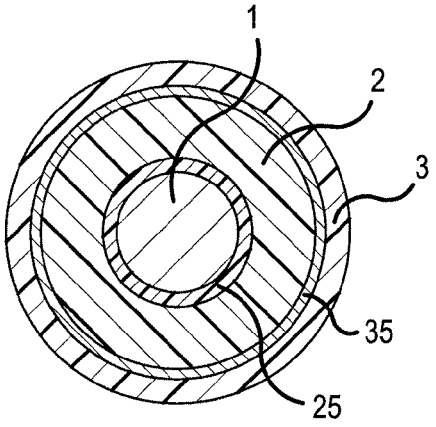
FIG. 3(*a*) is a cross-sectional view showing further embodiment of the insulated wire of the present invention, and FIG. 3(*b*) is a cross-sectional view showing still further embodiment of the insulated wire of the present invention.
Figure 3B:
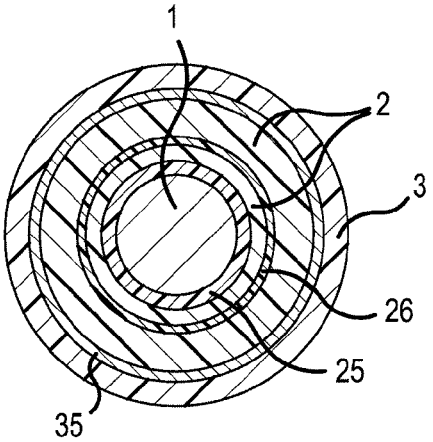

In yet another embodiment of the insulated wire of the present invention, whose cross-sectional view is shown in FIG. 3(*a*), the insulated wire is the same as the insulated wire shown in FIG. 2(*a*), except that adhesion layer 35 has been interposed between foamed insulating layer 2 composed of a thermosetting resin having cells and outer insulating layer 3.

In another embodiment of the insulated wire of the present invention, which is shown in FIG. 3(*b*), the insulated wire is the same as the insulated wire shown in FIG. 2(*b*), except that adhesion layer 35 has been interposed between foamed insulating layer 2 composed of a thermosetting resin having cells and outer insulating layer 3.

In the present invention, adhesion layer 35 is provided between foamed insulating layer 2 having cells and outer insulating layer 3 and it is a layer for improving an interlayer adhesion force between foamed insulating layer 2 and outer insulating layer 3.

In the Figures shown above, the same reference symbols respectively mean the same members, and further description will not be repeated herein.

Conductor 1 is made of, for example, copper, a copper alloy, aluminum, an aluminum alloy, or a combination thereof. The cross-sectional shape of conductor 1 is not limited, and a circular shape, a rectangular shape (perpendicular shape), and the like can be applied.

Inner insulating layer 25 is formed on the outer periphery of conductor 1 and it is a layer formed into a state having no cells by a thermosetting resin for forming foamed insulating layer 2 described below.

Besides, internal insulating layer 26 is a layer formed on the inside of foamed insulating layer 2 and into a state having no cells by a thermosetting resin for forming foamed insulating layer 2 described below.

In the present invention, inner insulating layer 25 and internal insulating layer 26 are formed on demand.

Foamed insulating layer 2 is a layer containing a thermosetting resin having cells, and has been formed on the outer periphery of conductor 1. The thermosetting resin for forming foamed insulating layer 2 is preferably capable of being adjusted to a varnish state so as to be applied and baked on conductor 1 thereby to form an insulating film. For example, polyether imide (PEI), polyether sulfone (PES), polyimide (PI), polyamideimide (PAI), and polyesterimide (PEsI) can be used.

More preferred examples include polyimide (PI) and polyamideimide (PAI) having excellent solvent resistance. In the present invention, a thermosetting resin is used for the insulating film, but the polyamideimide resin and the like that will be described below are preferably used.

Meanwhile, regarding the resin used, one kind may be used alone, or two or more kinds may be used in mixture.

Regarding the polyamideimide resin, a commercially available product (for example, HI406 (trade name, manufactured by Hitachi Chemical Co., Ltd.) can be used, or, for example, a product obtained by allowing a tricarboxylic acid anhydride to directly react with diisocyanates by a conventional method in a polar solvent can be used.

As a polyimide, for example, U-IMIDE (trade name, manufactured by UNITIKA LTD.), U-VARNISH (trade name, manufactured by Ube Industries, Ltd.), HCI Series (trade name, manufactured by Hitachi Chemical Co., Ltd.) and AURUM (trade name, manufactured by Mitsui Chemicals, Inc.) can be used.

In the present invention, various additives such as a cell (foam) nucleating agent, an oxidation inhibitor, an antistatic agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer may be incorporated into the thermosetting resin for forming foamed insulating layer 2, to the extent that the characteristics are not affected. Furthermore, separately from foamed insulating layer 2, a layer formed from a resin containing these additives may be laminated on the resulting insulated wire, or the insulated wire may be coated with a coating material containing these additives.

Furthermore, the thermosetting resin may be mixed with a thermoplastic resin having a high glass transition temperature. By incorporating the thermoplastic resin, flexibility and elongation characteristics are improved. The glass transition temperature of the thermoplastic resin is preferably 180° C. or higher, and more preferably from 210 to 350° C. The addition amount of such a thermoplastic resin is preferably 5 to 50 mass % of the resin solid content.

The thermoplastic resin that can be used for this purpose is not limited in particular, as long as it is a non-crystalline resin. For example, the thermoplastic resin is preferably at least one selected from polyether imide, polyether sulfone, polyphenylene ether, polyphenylsulfone (PPSU), and polyimide. Examples of the polyether imide that can be used include ULTEM (manufactured by GE Plastics, Inc., trade name). Examples of the polyether sulfone that can be used include SUMIKA EXCEL PES (trade name, manufactured by Sumitomo Chemical Co., Ltd.), PES (trade name, manufactured by Mitsui Chemicals, Inc.), ULTRAZONE E (trade name, manufactured by BASF Japan Ltd.), and RADEL A (trade name, manufactured by Solvay Advanced Polymers). Examples of the polyphenylene ether that can be used include XYRON (trade name, manufactured by Asahi Kasei Chemicals Corp.) and IUPIACE (trade name, manufactured by Mitsubishi Engineering-Plastics Corp.). Examples of the polyphenylsulfone that can be used include RADEL R (trade name, manufactured by Solvay Advanced Polymers). Examples of the polyimide that can be used include U-VARNISH (trade name, manufactured by Ube Industries, Ltd.), HCI Series (trade name, manufactured by Hitachi Chemical Co., Ltd.), U-IMIDE (trade name, manufactured by UNITIKA LTD.), and AURUM (trade name, manufactured by Mitsui Chemicals, Inc.). From the viewpoint of being easily dissoluble in a solvent, polyphenylsulfone and polyether imide are more preferred.

In order to decrease a relative dielectric constant of foamed insulating layer 2 formed of a thermosetting resin having cells, an expansion ratio of foamed insulating layer 2 is preferably 1.2 times or more, and more preferably 1.4 times or more. There are no particular limitations on the upper limit of the expansion ratio, but it is usually preferable to set the expansion ratio to 5.0 times or less. The expansion ratio is obtained by determining the density of the resin coated for foaming (ρf) and the density of the resin before foaming (ρs) by the underwater replacement method, and calculating the expansion ratio from (ρs/ρf).

Foamed insulating layer 2 has an average cell size of preferably 5 μm or less, more preferably 3 μm or less, and further preferably 1 μm or less. Since a dielectric breakdown voltage may be decreased when the average cell size exceeds 5 μm, the dielectric breakdown voltage can be maintained successfully by adjusting the average cell size to 5 μm or less. Furthermore, the dielectric breakdown voltage can be retained more certainly by adjusting the average cell size to 3 μm or less. Although the lower limit of the average cell size is not limited, it is practical and preferable that the lower limit is 1 nm or more. The average cell size is a value obtained in such a way that a cross-section of foamed insulating layer 2 is observed with a scanning electron microscope (SEM), and then the diameter of each of arbitrarily-selected 20 cells is measured in a diameter measurement mode using an image size measurement software (WinROOF, manufactured by MITANI Corporation), and then the measured values are averaged to obtain the average cell size. This cell size can be adjusted by an expansion ratio, a concentration of the resin, a viscosity, a temperature, an addition amount of the foaming agent, a temperature of the baking furnace, and the like.

Although the thickness of foamed insulating layer 2 is not limited, the thickness is preferably from 5 to 200 μm, and it is practical and more preferable that the thickness is from 10 to 200 μm.

The relative dielectric constant of foamed insulating layer 2 can be reduced by incorporating air therein, hence foamed insulating layer 2 allows suppression of partial discharge or corona discharge which occurs at an air gap between wires when a voltage is applied thereto.

Foamed insulating layer 2 can be obtained by applying an insulating varnish onto the periphery of conductor 1 and then baking it. The insulating varnish can be obtained by mixing a thermosetting resin and two or more kinds, preferably three or more kinds, of solvents containing a specific organic solvent and at least one kind of a high-boiling solvent. Application of the varnish may be carried out directly on conductor 1, or may be carried out with another resin layer interposed therebetween.

The organic solvent for the varnish used in foamed insulating layer 2 acts as a solvent for dissolving the thermosetting resin. This organic solvent is not particularly limited as long as the organic solvent does not inhibit the reaction of the thermosetting resin, and examples thereof include amide-based solvents such as N-methyl-2-pyrrolidone (NMP), N,N-dimethylacetamide (DMAC), dimethylsulfoxide, and N,N-dimethylformamide; urea-based solvents such as N,N-dimethylethyleneurea, N,N-dimethylpropyleneurea, and tetramethylurea; lactone-based solvents such as γ-butyrolactone and γ-caprolactone; carbonate-based solvents such as propylene carbonate; ketone-based solvents such as methyl ethyl ketone, methyl isobutyl ketone, and cyclohexanone; ester-based solvents such as ethyl acetate, n-butyl acetate, butyl cellosolve acetate, butyl carbitol acetate, ethyl cellosolve acetate, and ethyl carbitol acetate; glyme-based solvents such as diglyme, triglyme, and tetraglyme; hydrocarbon-based solvents such as toluene, xylene, and cyclohexane; and sulfone-based solvents such as sulfolane. Among these, in view of high solubility, high reaction promotion properties or the like, an amide-based solvent or a urea-based solvent is preferred; and in view of having no hydrogen atom that is apt to inhibit a crosslinking reaction due to heating or the like, N-methyl-2-pyrrolidone, N,N-dimethylacetamide, N,N-dimethylethyleneurea, N,N-dimethylpropyleneurea or tetramethylurea is further preferred, and N-methyl-2-pyrrolidone is particularly preferred. The boiling point of this organic solvent is preferably 160° C. to 250° C., and more preferably 165° C. to 210° C.

The high boiling solvent that can be used for cell formation is a solvent having a boiling point of preferably 180° C. to 300° C., and more preferably 210° C. to 260° C. Specific examples that can be used for cell formation include diethylene glycol dimethyl ether, triethylene glycol dimethyl ether, diethylene glycol dibutyl ether, tetraethylene glycol dimethyl ether, and tetraethylene glycol monomethyl ether. From the viewpoint of having a smaller fluctuation in the cell size, triethylene glycol dimethyl ether is more preferred. In addition to the above solvents, the examples include dipropylene glycol dimethyl ether, diethylene glycol ethyl methyl ether, dipropylene glycol monomethyl ether, diethylene glycol diethyl ether, diethylene glycol monomethyl ether, diethylene glycol butyl methyl ether, tripropylene glycol dimethyl ether, diethylene glycol monobutyl ether, ethylene glycol monophenyl ether, triethylene glycol monomethyl ether, triethylene glycol butyl methyl ether, polyethylene glycol dimethyl ether, polyethylene glycol monomethyl ether, and propylene glycol monomethyl ether.

As a high boiling solvent, one kind thereof may be used, but at least two kinds thereof are preferably used in combination in that an effect of cell generation over a wide temperature range is obtained. Preferred combinations of at least two kinds of the high boiling solvents include tetraethylene glycol dimethyl ether with diethylene glycol dibutyl ether, diethylene glycol dibutyl ether with triethylene glycol dimethyl ether, triethylene glycol monomethyl ether with tetraethylene glycol dimethyl ether, and triethylene glycol butyl methyl ether with tetraethylene glycol dimethyl ether. More preferred combinations include diethylene glycol dibutyl ether with triethylene glycol dimethyl ether, and triethylene glycol monomethyl ether with tetraethylene glycol dimethyl ether.

The high boiling solvent for cell formation preferably has a boiling point higher than that of the solvent for dissolving the thermosetting resin, and in the case where one kind of the high boiling solvent is added to the varnish, it is preferable that the boiling point of the high boiling solvent be higher by 10° C. or more than that of the solvent for dissolving the thermosetting resin. Furthermore, it is understood that in the case where one kind of the high boiling solvent is used, the high boiling solvent takes the role of both a cell nucleating agent and a foaming agent. On the other hand, in the case where two or more kinds of the high boiling solvents are used, the solvent having the highest boiling point acts as a foaming agent, and a high boiling solvent for cell formation having an intermediate boiling point acts as a cell nucleating agent. The solvent having the highest boiling point preferably has a boiling point that is higher by 20° C. or more, and more preferably by 30° C. to 60° C., than the specific solvent. The high boiling solvent for cell formation having the intermediate boiling point may have a boiling point that is intermediate between the boiling point of the solvent that acts as a foaming agent and the boiling point of the specific solvent, and preferably has a difference in boiling point of 10° C. or more from the boiling point of the foaming agent. In the case where the high boiling solvent for cell formation having the intermediate boiling point has a higher solubility for the thermosetting resin than the solvent that acts as a foaming agent, uniform cells can be formed after varnish baking. In the case where the two or more kinds of the high boiling solvents are used, the use ratio of the high boiling solvent having the highest boiling point to the high boiling solvent having the intermediate boiling point is, for example, preferably from 99/1 to 1/99 in terms of mass ratio, and more preferably from 10/1 to 1/10 in the point of easiness of cell formation.

Outer insulating layer 3 is formed of a specific thermoplastic resin on the outer side of foamed insulating layer 2. The present inventors have found that an air gap can be filled by providing a layer of the thermoplastic resin as outer insulating layer 3 on this foamed insulating layer 2, by utilizing a fact that the shape of foamed insulating layer 2 can be changed by incorporating air therein, hence outer insulating layer 3 is excellent in performance of suppressing occurrence of partial discharge.

In order to further enhance this effect, as a thermoplastic resin used in outer insulating layer 3, a thermoplastic resin having a glass transition temperature of 240° C. or higher in the case where the thermoplastic resin is a non-crystalline resin, or a thermoplastic resin having a melting point of 240° C. or higher in the case where the thermoplastic resin is a crystalline resin, is used.

The melting point or glass transition temperature of the thermoplastic resin is preferably 250° C. or higher, and the upper limit thereof is not limited in particular, and 450° C. is exemplified.

The insulated wire of the present invention is used for a member of electric components, and therefore a thermoplastic resin which is excellent in heat resistance and chemical resistance is preferably used for a material of outer insulating layer 3. In the present invention, as such a thermoplastic resin, thermoplastic resins including, for example, engineering plastics and super engineering plastics or the like are suitable for use.

Examples of the engineering plastics and the super engineering plastics include: general-purpose engineering plastics such as polyamide (PA, may also be called NYLON), polyacetal (POM), polycarbonate (PC), polyphenylene ether (including a modified polyphenylene ether), polybutylene terephthalate (PBT), polyethylene terephthalate (PET), a syndiotactic polystyrene resin (SPS), polyethylene naphthalate (PEN), and ultrahigh molecular weight polyethylene; and in addition, super engineering plastics such as polysulfone (PSF), polyether sulfone (PES), polyphenylene sulfide (PPS), polyarylate (U polymer), polyamideimide, polyether ketone (PEK), polyarylether ketone (PAEK), polyether ether ketone (PEEK), polyimide (PI), a thermoplastic polyimide resin (TPI), polyamideimide (PAI), and a liquid crystal polyester; and further polymer alloys containing the foregoing engineering plastics such as a polymer alloy composed of polyethylene terephthalate (PET) or polyethylene naphthalate (PEN) as a base resin, ABS/polycarbonate, polyphenylene ether/NYLON 6,6, polyphenylene ether/polystyrene, and polybutylene terephthalate/polycarbonate. In the present invention, from the viewpoints of heat resistance and stress crack resistance, a syndiotactic polystyrene resin (SPS), polyphenylene sulfide (PPS), polyarylether ketone (PAEK), polyether ether ketone (PEEK), and a thermoplastic polyimide resin (TPI) may be preferably used in particular. Further, it is needless to say that the resin to be used is not limited by the above-described resin names, and resins other than those recited above also can be used, as long as they are superior in performance to those resins.

Among these, examples of crystalline thermoplastic resins include: general-purpose engineering plastics such as polyamide (PA), polyacetal (POM), polybutylene terephthalate (PBT), polyethylene terephthalate (PET), polyphenylene sulfide (PPS), and ultrahigh molecular weight polyethylene; and polyether ether ketone (PEEK), polyether ketone (PEK), polyarylether ketone (PAEK) (including modified PEEK), and a thermoplastic polyimide resin (TPI). Further, polymer alloys using the above-described crystalline resins are exemplified. On the other hand, examples of non-crystalline thermoplastic resins include polycarbonate (PC), polyphenylene ether, polyarylate, a syndiotactic polystyrene resin (SPS), polyamideimide (PAI), polybenzoimidazole (PBI), polysulfone (PSF), polyether sulfone (PES), polyetherimide (PEI), polyphenyl sulfone (PPSU), and a non-crystalline thermoplastic polyimide resin.

In the present invention, from these thermoplastic resins, a crystalline thermoplastic resin having a melting point of 240° C. or higher, or a non-crystalline thermoplastic resin having a glass transition temperature of 240° C. or higher is selected. Examples of the crystalline thermoplastic resin having a melting point of 240° C. or higher include a thermoplastic polyimide resin (TPI) (mp. 388° C.), PPS (mp. 275° C.), PEEK (mp. 340° C.), and polyaryl ether ketone (PAEK) (mp. 340° C.). Examples of the non-crystalline thermoplastic resin having a glass transition temperature of 240° C. or higher include a non-crystalline thermoplastic polyimide resin (Tg. 250° C.), polyamideimide (PAI) (Tg. 280 to 290° C.), polyamideimide (PAI) (Tg. 435° C.), and a syndiotactic polystyrene resin (SPS) (Tg. 280° C.). The melting point can be measured by observing a melting temperature of the sample (10 mg) at a temperature-increasing rate of 10° C./min using a DSC (differential scanning calorimeter, DSC-60 (trade name) manufactured by Shimadzu Corporation). The glass transition temperature can be measured by observing a glass transition temperature of the sample (10 mg) at a temperature-increasing rate of 10° C./min using the DSC in the same manner as the melting point.

As outer insulating layer 3, there is no problem, as long as it contains a crystalline thermoplastic resin having a melting point of 240° C. or higher, or a non-crystalline thermoplastic resin having a glass transition temperature of 240° C. or higher. In place of or in addition to these thermoplastic resins, incorporation of a crystalline thermoplastic resin having a melting point of 270° C. or higher is preferable in that heat resistance is further improved and in addition, a mechanical strength also tends to be enhanced, hence an effect of enhancing a performance of the winding is obtained. The content of the crystalline thermoplastic resin having a melting point of 270° C. or higher in outer insulating layer 3 is preferably 10% by mass or more, and particularly preferably 60% by mass or more of the resin component that forms outer insulating layer 3. Details of the crystalline thermoplastic resin having a melting point of 270° C. or higher are the same as previously described.

As the thermoplastic resin contained in outer insulating layer 3, the storage elastic modulus at 25° C. thereof is preferably 1 GPa or more. In the case where the storage elastic modulus at 25° C. is less than 1 GPa, an effect of the thermoplastic resin on a shape-change is high, but an abrasion characteristic decreases, and therefore problems may occur such that a low load condition is required when coil-molding is performed. In the case of 1 GPa or more, without impairing a shape-changeable ability of the thermoplastic resin, abrasion resistance can be maintained at a good level. The storage elastic modulus of the thermoplastic resin is more preferably 2 GPa or more at 25° C. The upper limit of the storage elastic modulus is not limited in particular. However, in the case of too high storage elastic modulus, there arises a problem that flexibility required for the winding reduces after all and therefore it is favorable that the upper limit is, for example, 6 GPa.

In the present invention, the storage elastic modulus of the thermoplastic resin which forms each insulating layer of the insulated electric wire is a value that is measured by using a viscoelasticity analyzer (DMS200 (trade name): manufactured by Seiko Instruments Inc.). In particular, by using a 0.2 mm thick specimen which has been prepared with the thermoplastic resin which forms each insulating layer of the insulated electric wire, and by recording a measured value of the storage elastic modulus at the state when the temperature is stabilized at 25° C. under the conditions that a rate of temperature increase is 2° C./min and a frequency is 10 Hz, the recorded value is defined as a storage elastic modulus at 25° C. of the thermoplastic resin.

Examples of the thermoplastic resin contained in outer insulating layer 3, whose storage elastic modulus at 25° C. is 1 GPa or more include: commercially available products such as PEEK450G manufactured by Victrex Japan Inc. (trade name, storage elastic modulus at 25° C.: 3840 MPa, storage elastic modulus at 300° C.: 187 MPa, melting point: 340° C.) as the PEEK; AVASPIRE AV-650 manufactured by Solvay Plastics (trade name, storage elastic modulus at 25° C.: 3700 MPa, storage elastic modulus at 300° C.: 144 MPa, melting point: 345° C.) or AV-651 (trade name, storage elastic modulus at 25° C.: 3500 MPa, storage elastic modulus at 300° C.: 130 MPa, melting point: 345° C.) as the modified PEEK; AURUM PL 450C manufactured by Mitsui Chemicals, Inc. (trade name, storage elastic modulus at 25° C.: 1880 MPa, storage elastic modulus at 300° C.: 18.9 MPa, melting point: 388° C.) as the TPI; FORTRON 0220A9 manufactured by Polyplastics Co., Ltd. (trade name, storage elastic modulus at 25° C.: 2800 MPa, storage elastic modulus at 300° C.: <10 MPa, melting point: 278° C.), or PPS FZ-2100 manufactured by DIC Corporation (trade name, storage elastic modulus at 25° C.: 1600 MPa, storage elastic modulus at 300° C.: <10 MPa, melting point: 275° C.) as the PPS; XAREC S105 manufactured by Idemitsu Kosan Co., Ltd. (trade name, storage elastic modulus at 25° C.: 2200 MPa, glass transition temperature: 280° C.) as the SPS; and NYLON 6,6 (manufactured by UNITIKA LTD.: FDK-1 (trade name), storage elastic modulus at 25° C.: 1200 MPa, storage elastic modulus at 300° C.: <10 MPa, melting point: 265° C.), NYLON 4,6 (manufactured by UNITIKA LTD.: F-5000 (trade name), storage elastic modulus at 25° C.: 1100 MPa, melting point: 292° C.), NYLON 6,T (manufactured by Mitsui Chemicals, Inc.: ARLENE AE-420 (trade name), storage elastic modulus at 25° C.: 2400 MPa, melting point: 320° C.), and NYLON 9,T (manufactured by KURARAY CO., LTD.: GENESTOR N-1006D (trade name), storage elastic modulus at 25° C.: 1400 MPa, melting point: 262° C.) as the PA.

Outer insulating layer 3 contains substantially no partial discharge resistant substance. Herein, the partial discharge resistant material refers to an insulating material that is not susceptible to partial discharge deterioration, and the material has an action of enhancing the characteristic of voltage-applied lifetime by dispersing the material in the insulating film of the wire. Examples of the partial discharge resistant material include oxides (oxides of metals or non-metal elements), nitrides, glass and mica, and specific examples of the partial discharge resistant material 3 include fine particles of silica, titanium dioxide, alumina, barium titanate, zinc oxide, and gallium nitride. Further, the expression "contains substantially no" partial discharge resistant substance means that the partial discharge resistant substance is not contained in outer insulating layer 3 in a positive manner, and therefore this expression incorporates not only the case of completely no inclusion, but also the case of inclusion in a content of such a degree that a purpose of the present invention is not impaired. Examples of the content of such a degree that a purpose of the present invention is not impaired include the content of 30 parts by mass or less with respect to 100 parts by mass of the resin component which forms outer insulating layer 3.

Various additives such as an oxidation inhibitor, an anti-static agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer may be incorporated into the thermoplastic resin which forms outer insulating layer 3, to the extent that the characteristics are not affected.

The thickness of outer insulating layer 3 is not limited in particular, but it is preferably from 5 to 150 μm, and more preferably from 20 to 150 μm because this range is practical.

Further, it is preferable that the thickness ratio of foamed insulating layer 2 to outer insulating layer 3 is appropriate. Specifically, as foamed insulating layer 2 becomes thicker, the relative dielectric constant decreases, hence it is possible to increase the partial discharge inception voltage. On the other hand, abrasion resistance may decrease. In the case where increase in mechanical properties such as strength and flexibility is desired, it is preferable that outer insulating layer 3 is designed so as to make the layer thicker. The present inventors have found that if the thickness ratio of foamed insulating layer 2 to outer insulating layer 3 (foamed insulating layer 2/outer insulating layer 3) is from 5/95 to 95/5, advantages are developed in that the strength and the partial discharge inception voltage are increased. In the case where increase in mechanical properties is required in particular, the thickness ratio is preferably from 5/95 to 60/40.

Further, as seen in the present invention, in the case where cells are formed in foamed insulating layer 2 and outer insulating layer 3 having no cells is formed on the outside layer of foamed insulating layer 2, a gap caused by the coil formation can be filled by deformation due to slight crash by itself. In the case where there is no gap, partial discharge or corona discharge which occurs between wires can be effectively suppressed.

In the present invention, the expression "having no cells" includes not only the state in which completely no cells exist, but also the state in which cells exist to such a degree that a purpose of the present invention is not impaired. As the degree that a purpose of the present invention is not impaired, the cells exist, for example, to the extent that the proportion of the total area of the cells is not more than 20% with respect to the entire area of the cross section of outer insulating layer 3.

Outer insulating layer 3 can be formed by molding a thermoplastic resin composition containing a thermoplastic resin on the periphery of foamed insulating layer 2 by a molding method such as extrusion molding. The thermoplastic resin composition may be molded directly on the periphery of foamed insulating layer 2, or may be molded indirectly by interposing another resin layer in between. In this thermoplastic resin composition, in addition to the thermoplastic resin, for example, various kinds of additives or the above-described organic solvents and the like, which are added to a varnish for forming foamed insulating layer 2, may be contained to the extent that the characteristics are not affected.

Adhesion layer 35 is formed of a non-crystalline thermoplastic resin which is similar to the non-crystalline thermoplastic resin for forming outer insulating layer 3, between foamed insulating layer 2 and outer insulating layer 3. Adhesion layer 35 and outer insulating layer 3 may be formed of the same non-crystalline thermoplastic resin, or may be formed of a different non-crystalline thermoplastic resin from one another. Adhesion layer 35 is formed, for example, as a thin film of less than 5 μm. Meanwhile, depending on the molding conditions of outer insulating layer 3, an accurate thickness thereof may not be measured when adhesion layer 35 and outer insulating layer 3 has intermingled with each other to form an insulated wire.

The insulated wire of the present invention can be produced by forming a foamed insulating layer on the outer periphery of a conductor, and then forming thereon an outer insulating layer. Specifically, the insulated wire can be produced by performing a step of forming foamed insulating layer 2 by applying directly or indirectly, namely if desired, via inner insulating layer 25, a varnish for forming foamed insulating layer 2 on the outer periphery of conductor 1, and generating foams in the process of baking; and a step of forming the outer insulating layer by extrusion-molding a thermoplastic resin composition for forming the outer insulating layer on the outer periphery of the foamed insulating layer.

Here, the baking is not limited in particular, as long as it allows evaporation of the solvent and curing of the thermosetting resin. Examples thereof include a method of heating at 500 to 600° C. by means of an air-heating furnace, an electric furnace and the like.

Inner insulating layer 25 and internal insulating layer 26 can be formed respectively by applying a varnish for forming inner insulating layer 25 or internal insulating layer 26 and then baking it, or by molding a resin composition.

Adhesion layer 35 can be formed by applying, onto foamed insulating layer 2, a coating material in which a non-crystalline thermoplastic resin similar to the non-crystalline thermoplastic resin for forming outer insulating layer 3 has been dissolved in a solvent, and then evaporating the solvent.

The insulated wire of the present invention has the above-described features and therefore it is applicable to a field which requires resistance to voltage and heat resistance, such as various kinds of electrical equipment (may be also called electronic equipment). For example, the insulated wire of the present invention is used for a motor, a transformer and the like, which can compose high-performance electrical equipment. In particular, the insulated wire is preferably used as a winding for a driving motor of HV (Hybrid Vehicles) and EV (Electric Vehicles).

As just described, the present invention can provide electrical equipment, particularly a driving motor of HV and EV, equipped with the insulated wire. Meanwhile, in the case where the insulated wire of the present invention is used for a motor coil, it is also called an insulated wire for the motor coil.

EXAMPLES

The present invention will be described in more detail based on examples given below, but the invention is not meant to be limited by these. Meanwhile, in the following Examples, the percent value (%) indicating the composition means percent (%) by mass.

Insulated wires of Examples and Comparative Examples were produced as follows.

(Example 1)

The insulated wire shown in FIG. 2(*a*) was produced as follows.

First, a foamable polyamideimide varnish used for forming foamed insulating layer 2 was prepared as follows. In a 2 L volumetric separable flask, 1,000 g of HI-406 series (an NMP solution of 32% by mass of the resin component; boiling point of NMP: 202° C.) (trade name, manufactured by Hitachi Chemical Co., Ltd.) was placed, and 100 g of triethylene glycol dimethyl ether (boiling point: 216° C.) and 150 g of diethylene glycol dibutyl ether (boiling point: 256° C.) as cell forming agents were added thereto. Thus, the foamable polyamideimide varnish was obtained. In addition, as a polyamideimide varnish for forming inner insulating layer 25, which is used to form inner insulating layer 25, HI-406 series (an NMP solution of 32% by mass of the resin component) was used. With respect to 1,000 g of the resin, NMP was used as a solvent to make a 30% resin solution.

Each varnish was applied by dip coating, and a coating amount thereof was adjusted using a die. Specifically, the thus-prepared polyamideimide varnish for forming inner insulating layer 25 was applied onto copper conductor 1 of 1.0 mm ϕ and this was baked at a furnace temperature of 500° C. to form inner insulating layer 25 with a thickness of 4 μm. Next, the thus-prepared foamable polyamideimide varnish was applied onto inner insulating layer 25. This was baked at a furnace temperature of 500° C. to form foamed insulating layer 2 with a thickness of 19 μm. A molding (may be also referred to as an undercoat wire) of inner insulating layer 25 and foamed insulating layer 2 formed in this way was obtained. Next, the undercoat wire was coated with a PPS resin (FZ-2100 manufactured by DIC Corporation; melting point: 275° C., storage elastic modulus: 1.6 GPa) so as to have a thickness of 33 μm under the conditions of a die temperature of 320° C. and a resin pressure of 30 MPa using an extruder. Thus, the insulated wire of Example 1 was produced.

(Example 2)

The insulated wire shown in FIG. 1(*a*) was produced as follows. The foamable polyamideimide varnish prepared in Example 1 was applied directly onto the periphery of copper conductor 1 of 1.0 mm ϕ and this was baked at a furnace temperature of 500° C. to obtain a molding (undercoat wire) in which foamed insulating layer 2 had been formed with a thickness of 70 μm. Next, the undercoat wire was coated with a TPI resin (manufactured by Mitsui Chemicals, Inc., PL450C, melting point: 388° C., storage elastic modulus: 1.9 GPa) so as to have a thickness of 8 μm under the conditions of a die temperature of 380° C. and a resin pressure of 30 MPa using an extruder. Thus, the insulated wire of Example 2 was produced.

(Example 3)

The insulated wire shown in FIG. 2(*a*) was produced as follows.

First, a foamable polyimide varnish used to form foamed insulating layer 2 was prepared as follows. In a 2 L volumetric separable flask, 1,000 g of U imide (an NMP solution of 25% by mass of the resin component) (trade name, manufactured by UNITIKA LTD.) was placed, and 75 g of NMP (boiling point 202° C.), 150 g of DMAC (boiling point 165° C.), and 200 g of tetraethylene glycol dimethylether (boiling point 275° C.) as solvents were added thereto. Thus, the foamable polyimide varnish was obtained. A polyimide varnish for forming inner insulating layer 25, which is used to form inner insulating layer 25, was prepared by using U imide and adding 250 g of DMAC as a solvent to 1000 g of the resin.

The polyimide varnish for forming inner insulating layer 25 was applied onto the outer periphery of copper conductor 1 of 1.0 mm ϕ and this was baked at a furnace temperature of 500° C. to form inner insulating layer 25 with a thickness of 4 μm. Next, the thus-prepared foamable polyimide varnish was applied onto inner insulating layer 25. This was baked at a furnace temperature of 500° C. to form foamed insulating layer 2 with a thickness of 60 μm. A molding (undercoat wire) of inner insulating layer 25 and foamed insulating layer 2 formed in this way was obtained. Next, the undercoat wire was coated with a PEEK resin (manufactured by Victrex Plc, trade name: PEEK450G, melting point: 340° C., storage elastic modulus: 3.8 GPa) so as to have a thickness of 30 μm under the conditions of a die temperature of 420° C. and a resin pressure of 30 MPa using an extruder. Thus, the insulated wire of Example 3 was produced.

(Example 4)

The insulated wire shown in FIG. 2(*a*) was produced as follows. First, a foamable polyesterimide varnish (in Table 1, PEsI) used to form foamed insulating layer 2 was prepared as follows. Ina 2 L volumetric separable flask, 1,000 g of polyesterimide varnish (Neoheat 8600A; trade name, manufactured by TOTOKU TORYO CO., LTD.) was placed, and 75 g of NMP (boiling point 202° C.), 50 g of DMAC (boiling point 165° C.), and 200 g of triethyleneglycol dimethylether (boiling point 216° C.) as solvents were added thereto. Thus, the foamable polyesterimide varnish was obtained. A polyesterimide varnish for forming inner insulating layer 25, which is used to form inner insulating layer 25, was prepared by using Neoheat 8600A and adding 250 g of DMAC as a solvent to 1,000 g of the resin.

The polyesterimide varnish for forming inner insulating layer 25 was applied onto the outer periphery of copper conductor 1 of 1.0 mm ϕ and this was baked at a furnace temperature of 500° C. to form inner insulating layer 25 with a thickness of 3 μm. Next, the thus-prepared foamable polyesterimide varnish was applied onto inner insulating layer 25. This was baked at a furnace temperature of 500° C. to form foamed insulating layer 2 with a thickness of 5 μm. A molding (undercoat wire) of inner insulating layer 25 and foamed insulating layer 2 formed in this way was obtained. Next, the undercoat wire was coated with an SPS resin (XAREC S105 manufactured by Idemitsu Kosan Co., Ltd.; glass transition temperature: 280° C., storage elastic modulus: 2.2 GPa) so as to have a thickness of 90 μm under the conditions of a die temperature of 360° C. and a resin pressure of 20 MPa using an extruder. Thus, the insulated wire of Example 4 was produced.

(Example 5)

The insulated wire shown in FIG. 3(*a*) was produced as follows. The undercoat wire was prepared in the same manner as in Example 1, except that their film thicknesses were different from one another. Next, onto foamed insulating layer 2 of the undercoat wire, a liquid in which 20 g of PPSU (RADEL R (trade name), manufactured by Solvay Plastics) had been dissolved in 100 g of NMP was applied, and this was baked at a furnace temperature of 500° C. in the same manner as foamed insulating layer 2 to form adhesion layer 35 with a film thickness of 2 μm. On the undercoat wire in which adhesion layer 35 has been formed as just described, a PPS resin was extrusion-molded so as to have a film thickness of 80 μm in the same manner as in Example 1, except that their film thicknesses were different from one another. Thus, the insulated wire of Example 5 was produced.

(Example 6)

The insulated wire of Example 6 was produced in the same manner as in Example 2, except that the film thickness of foamed insulating layer 2 was changed to 100 μm and the film thickness of outer insulating layer 3 was changed to 5 μm.

(Comparative Example 1)

The insulated wire of Comparative Example 1 was produced in the same manner as in Example 1, except that the film thickness of foamed insulating layer 2 was changed to 80 μm and outer insulating layer 3 was not formed.

(Comparative Example 2)

A PAI resin (HI-406 series, manufactured by Hitachi Chemical Co., Ltd.) was applied onto the outer periphery of copper conductor 1 of 1.0 mm ϕ, and this was baked at a furnace temperature of 500° C. to form an insulating layer with a film thickness of 19 μm, in which no cells were contained. Next, an undercoat wire was obtained by forming adhesion layer 35 on the insulating layer in the same manner as in Example 5. Next, a PPS resin was extrusion-molded so as to have a film thickness of 32 μm in the same manner as in Example 1, except that their film thicknesses were different from one another. Thus, the insulated wire of Comparative Example 2 was produced.

(Comparative Example 3)

A PAI resin (HI-406 series, manufactured by Hitachi Chemical Co., Ltd.) was applied onto the outer periphery of copper conductor 1 of 1.0 mm ϕ, and this was baked at a furnace temperature of 500° C. to form an insulating layer with a film thickness of 40 μm, in which no cells were contained. Thus, the insulated wire of Comparative Example 3 was produced.

(Comparative Example 4)

The insulated wire of Comparative Example 4 was produced in the same manner as in Example 5, except that a thermoplastic elastomer (TPE, manufactured by TOYOBO CO., LTD., P-150B (trade name), storage elastic modulus at 25° C.: 0.1 GPa, melting point: 212° C.) was used in place of PPS and the thickness thereof in Example 5 was changed.

The configurations, properties and evaluation test results of the insulated wires obtained in Examples 1 to 6 and Comparative Examples 1 to 4 are presented in Table 1. Methods for evaluation are described below.

[Measurement of Thickness, Expansion Ratio, Average Cell Size and the Like]

The thickness of each layer, the total thickness of the insulating layers, the expansion ratio of foamed insulating layer 2, the melting point (described by the mp notation in Table 1) or the glass transition temperature (described by the Tg notation in Table 1) of each thermoplastic resin which forms outer insulating layer 3 in Examples and Comparative Examples were measured as described above.

Further, regarding the average cell size of foamed insulating layer 2, twenty cells were selected at random in a scanning electron microscopical (SEM) image in the cross-section of the thickness direction of foamed insulating layer 2, and an average cell size was calculated in a size determination mode using an image size measurement software (WinROOF, manufactured by MITANI SHOJI Co., Ltd.), and the obtained value was defined as the cell size.

Further, a thickness ratio of foamed insulating layer 2 to outer insulating layer 3 (thickness of foamed insulating layer 2/thickness of outer insulating layer 3) was calculated.

These measured values and calculated values are shown in Table 1.

[Relative Dielectric Constant]

The electrostatic capacity of each of the produced insulated wires was measured, and the relative dielectric constant was obtained from the electrostatic capacity and the thickness of foamed insulating layer 2. For the measurement of the electrostatic capacity, LCR HITESTER (manufactured by Hioki E.E. Corp., Model 3532-50) was used. Measurement was conducted under the conditions that the measurement temperature was 25° C. and the measurement frequency was 100 Hz.

[Partial Discharge Inception Voltage]

Specimens were prepared by combining two insulated wires produced in each of Examples 1 to 6 and Comparative Examples 1 to 4 into a twisted form, an alternating voltage with sine wave 50 Hz was applied between the respective two conductors 1 twisted, and while the voltage was continuously raised, the voltage (effective value) at which the amount of discharged charge was 10 pC was determined. The measurement temperature was set at the normal temperature. For the measurement of the partial discharge inception voltage, a partial discharge tester (KPD2050, manufactured by Kikusui Electronics Corp.) was used. If the partial discharge inception voltage is 850V or more, partial discharge does not tend to occur whereby partial deterioration of the insulated wire can be prevented.

[Unidirectional Abrasiveness]

The unidirectional abrasiveness test was conducted in accordance with WS C3216. As the test equipment, NEMA scrape tester (manufactured by Toyo Seiki Seisaku-sho, Ltd.) was used. This test is conducted in such a way that a continuously increasing force is applied to a needle on a linear test specimen and a surface of the test specimen is scratched with the needle. A force at the time when conduction has occurred between the needle and a conductor was defined as a destructive force.

In the present invention, a test specimen whose destructive force was 2500 g or more was indicated by "⊙" as having good abrasiveness; a test specimen whose destructive force was 1500 g or more and less than 2500 g and the specimen was located at the sufficiently usable level was indicated by "○"; a test specimen whose destructive force was 1250 g or more and less than 1500 g and the mechanical properties of the specimen were within an acceptable level and usable as a product was indicated by "Δ"; and a test specimen whose destructive force was less than 1250 g, which means a difficult level of use because of easy conduction, was indicated by "×".

[Overall Evaluation]

As described above, the problem of the present invention is to balance reduction of a relative dielectric constant and improvement of a partial discharge inception voltage with improvement of a mechanical strength. Accordingly, the insulated wire which satisfied the following three items was indicated by "○" as such a wire passed the balancing requirements: relative dielectric constant of 3.2 or less; the partial discharge inception voltage of 850V or more; and the unidirectional abrasiveness evaluated as "Δ" or higher.

TABLE 1

| | | Example 1 | Example 2 | Example 3 | Example 4 | Example 5 | Example 6 |
|---|---|---|---|---|---|---|---|
| Inner insulating layer | Resin | PAI | — | PI | PEsI | PAI | — |
| | Thickness (μm) | 4 | — | 4 | 3 | 3 | — |
| Foamed insulating layer | Resin | Foamed PAI | Foamed PAI | Foamed PI | Foamed PEsI | Foamed PAI | Foamed PAI |
| | Thickness (μm) | 19 | 70 | 60 | 5 | 30 | 100 |
| | Expansion ratio (times) | 1.2 | 1.4 | 1.5 | 1.6 | 1.4 | 1.5 |
| | Average cell size (μm) | 2 | 3 | 5 | 5 | 3 | 5 |
| Adhesion layer | Resin | — | — | — | — | PPSU | — |
| Outer insulating layer | Resin | PPS | TPI | PEEK | SPS | PPS | TPI |
| | Mp or Tg (° C.) | 275 | 388 | 340 | 280 | 275 | 388 |
| | Storage elastic modulus (GPa) | 1.6 | 1.9 | 3.8 | 2.2 | 1.6 | 1.9 |
| | Thickness (μm) | 33 | 8 | 30 | 90 | 80 | 5 |
| Total thickness | (μm) | 56 | 78 | 94 | 98 | 113 | 105 |
| Thickness ratio | | 19/33 | 70/8 | 60/30 | 5/90 | 30/80 | 100/5 |
| (Conversion) | | 36.5/63.5 | 89.7/10.3 | 66.7/33.3 | 5.3/94.7 | 27.3/72.7 | 95.2/4.8 |
| Relative dielectric constant | | 2.7 | 1.9 | 2.5 | 2.4 | 2.5 | 2.5 |
| Partial discharge inception voltage (V) | | 900 | 1250 | 1190 | 1250 | 1310 | 1250 |
| Unidirectional abrasiveness | | ○ | ○ | ○ | ○ | ⊙ | Δ |
| Overall evaluation | | ○ | ○ | ○ | ○ | ○ | ○ |

| | | Comparative Example 1 | Comparative Example 2 | Comparative Example 3 | Comparative Example 4 |
|---|---|---|---|---|---|
| Inner | Resin | PAI | — | — | PAI |

TABLE 1-continued

| | | | | | |
|---|---|---|---|---|---|
| insulating layer | Thickness (μm) | 4 | — | — | 4 |
| Foamed | Resin | Foamed PAI | PAI | PAI | Foamed PAI |
| insulating layer | Thickness (μm) | 80 | 19 | 40 | 30 |
| | Expansion ratio (times) | 1.4 | — | — | 1.4 |
| | Average cell size (μm) | 3 | — | — | 3 |
| Adhesion layer | Resin | — | PPSU | — | PPSU |
| Outer | Resin | — | PPS | — | TPE |
| insulating layer | Mp or Tg (° C.) | — | 275 | — | 212 |
| | Storage elastic modulus (GPa) | — | 1.6 | — | 0.1 |
| | Thickness (μm) | — | 32 | — | 30 |
| Total thickness | (μm) | 84 | 51 | 40 | 64 |
| Thickness ratio | | 80/0 | 0/32 | 0/40 | 30/30 |
| (Conversion) | | 100/0 | 0/100 | 0/100 | 50/50 |
| Relative dielectric constant | | 2.3 | 3.5 | 3.9 | 2.4 |
| Partial discharge inception voltage (V) | | 1180 | 820 | 690 | 1050 |
| Unidirectional abrasiveness | | X | ⊙ | ⊙ | X |
| Overall evaluation | | X | X | X | X |

As seen from Table 1, in the insulated wires of Examples 1 to 6 having both foamed insulating layer 2 and outer insulating layer 3, both reduction in the relative dielectric constant and improvement in the partial discharge inception voltage by foam formation are recognized, and furthermore, the unidirectional abrasiveness was good, hence the insulated wires passed the standards of the overall evaluation.

In contrast, as seen from Comparative Examples 1 to 4 in Table 1, in each of Comparative Example 1 having no outer insulating layer 3 and Comparative Example 4 having outer insulating layer which is not formed of the specific thermoplastic resin, the unidirectional abrasiveness was poor.

In Comparative Example 2 having no foamed insulating layer 2, the relative dielectric constant was high and the partial discharge inception voltage was low. In Comparative Example 3 having neither foamed insulating layer 2 nor outer insulating layer 3, the relative dielectric constant was high and the partial discharge inception voltage was low, whereas, the unidirectional abrasiveness was excellent even though the insulated wire had no outer insulating layer 3.

As just described, each of the insulated wires of Comparative Examples 1 to 4 failed to balance a low-relative dielectric constant and a high-partial discharge inception voltage with high-mechanical strength, hence the insulated wires failed to pass the standards of the overall evaluation.

The insulated wires of Examples 1, 3 and 4 have a cross-section shown in FIG. 2 (*a*), the cross-section having inner insulating layer 25, foamed insulating layer 2 and outer insulating layer 3. The insulated wires of Examples 2 and 6 have a cross-section shown in FIG. 1 (*a*), the cross-section having foamed insulating layer 2 and outer insulating layer 3. The insulated wire of Example 5 has a cross-section shown in FIG. 3 (*a*), the cross-section having inner insulating layer 25, foamed insulating layer 2, adhesion layer 35 and outer insulating layer 3.

The insulated wires of the present invention are not limited to these, but various configurations containing inner insulating layer 25 and outer insulating layer 3 are adopted. For example, rectangular conductor 1, internal insulating layer 26 and the like can be employed, as shown in FIG. 1 (*b*), FIG. 2 (*b*) or FIG. 3 (*b*).

The present invention is not construed to be limited by the above-mentioned embodiments, and various modifications can be made within the scope of the technical matter of the present invention.

INDUSTRIAL APPLICABILITY

The present invention can be applied to fields requiring resistance to voltage and heat resistance, such as an automobile and other various kinds of electrical/electronic equipment. The insulated wire of the present invention can be used in a motor, a transformer and the like, and can provide high performance electrical/electronic equipment. Particularly, the insulated wire of the present invention is favorable as a coil for the driving motors of HV (hybrid vehicles) or EV (electric vehicles).

Having described our invention as related to the present embodiments, it is our intention that the invention not be limited by any of the details of the description, unless otherwise specified, but rather be construed broadly within its spirit and scope as set out in the accompanying claims.

REFERENCE SIGNS LIST

1 Conductor
2 Foamed insulating layer
3 Outer insulating layer
25 Inner insulating layer
26 Internal insulating layer
35 Adhesion layer

The invention claimed is:

1. An insulated wire comprising:

a conductor;

a foamed insulating layer containing a thermosetting resin having cells, coated directly or indirectly onto the outer periphery of the conductor; and an outer insulating layer containing a thermoplastic resin having a melting point of 240° C. or higher in the case where the thermoplastic resin is a crystalline resin or a thermoplastic resin having a glass transition temperature of 240° C. or higher in the case where the thermoplastic resin is a non-crystalline resin, on the outer side of the foamed insulating layer.

2. The insulated wire according to claim 1, wherein the thermoplastic resin has a storage elastic modulus of 1 GPa or more at 25° C.

3. The insulated wire according to claim 1, wherein a thickness ratio of the foamed insulating layer to the outer insulating layer (foamed insulating layer/outer insulating layer) is from 5/95 to 95/5.

4. The insulated wire according to claim 1, wherein the thermoplastic resin comprises a crystalline thermoplastic resin having a melting point of 270° C. or higher.

5. The insulated wire according to claim 1, used for a motor coil.

6. A method of producing the insulated wire according to claim 1, comprising the steps of:

forming a foamed insulating layer by applying directly or indirectly a varnish for forming the foamed insulating layer on the outer periphery of a conductor, and by generating foams in the process of baking; and forming an outer insulating layer by extrusion-molding a thermoplastic resin composition for forming the outer insulating layer on the outer periphery of the foamed insulating layer.

7. Electrical equipment, using the insulated wire according to claim 1.

* * * * *